US006663511B2

(12) United States Patent
Sullivan

(10) Patent No.: US 6,663,511 B2
(45) Date of Patent: Dec. 16, 2003

(54) GOLF BALL WITH DIMPLE PATTERNS HAVING DEPTH PROGRESSION

(75) Inventor: Michael J. Sullivan, Barrington, RI (US)

(73) Assignee: Callaway Golf Company, Carlsbad, CA (US)

( * ) Notice: Subject to any disclaimer, the term of this patent is extended or adjusted under 35 U.S.C. 154(b) by 128 days.

(21) Appl. No.: 09/769,127

(22) Filed: Jan. 25, 2001

(65) Prior Publication Data

US 2001/0003105 A1 Jun. 7, 2001

Related U.S. Application Data

(63) Continuation of application No. 09/247,948, filed on Feb. 11, 1999, now abandoned.

(51) Int. Cl.[7] ..... A63B 37/12; A63B 37/14

(52) U.S. Cl. ..... 473/378; 473/379; 473/383; 473/384

(58) Field of Search ..... 473/377, 378, 473/383, 384

(56) References Cited

U.S. PATENT DOCUMENTS 5,016,887 A * 5/1991 Jonkouski ..... 273/232
5,024,444 A * 6/1991 Yamagishi et al. ..... 273/232
5,033,750 A 7/1991 Yamagishi et al.
5,308,076 A * 5/1994 Sun ..... 273/232
5,332,226 A * 7/1994 Kim ..... 273/232
5,518,246 A 5/1996 Moriyama et al.
5,564,708 A * 10/1996 Hwang ..... 473/382
5,813,924 A * 9/1998 Yamagishi et al. ..... 473/377
5,890,974 A * 4/1999 Stiefel et al. ..... 473/384
5,935,023 A * 8/1999 Maehara et al. ..... 473/384
6,039,660 A * 3/2000 Kasashima et al. ..... 473/378
6,179,731 B1 * 1/2001 Shimosaka et al. ..... 473/384

* cited by examiner

*Primary Examiner*—Peter Vo
*Assistant Examiner*—Paul Kim

(57) ABSTRACT

A golf ball with superior aerodynamic properties is characterized by a progressive depth of dimples on the surface of the ball. The ball surface is divided into a plurality of equal geometries such as triangles, each of which is filled with a plurality of non-overlapping dimples. Groups of dimples are provided in each geometry, the dimples of each group having different depths, respectively. A first group of dimples is arranged about the perimeter of the geometry and a second group of dimples is arranged within the first group. A third group of dimples having a third depth may be provided within the second group, with the depth of the third group being less than the depth of the second group which is less than the depth of the first group. Alternatively, the depth of the third group is greater than the depth of the second group which is greater than the depth of the first group. Similarly, the first and third groups may have the same depth but different from the second group.

6 Claims, 2 Drawing Sheets

GOLF BALL WITH DIMPLE PATTERNS HAVING DEPTH PROGRESSION

This is a continuation of application Ser. No. 09/247,948 filed Feb. 11, 1999, now abandoned.

BACKGROUND OF THE INVENTION

The present invention relates to a new configuration for the dimples on a golf ball surface which improves the aerodynamic characteristics of the ball.

According to the United States Golf Association (U.S.G.A.) Rules, a golf ball may not have a weight in excess of 1.620 ounces or a diameter smaller than 1.680 inches. The initial velocity of balls conforming to U.S.G.A. regulations may not exceed 250 feet per second with a maximum tolerance of 2%. Initial velocity is measured on a standard machine kept by the U.S.G.A. A projection on a wheel rotating at a defined speed hits the test ball, and the length of time it takes the ball to traverse a set distance after impact is measured. U.S.G.A. regulations also require that a ball not travel a distance greater than 280 yards when hit by the U.S.G.A. outdoor driving machine under specifies conditions. In addition to this specification, there is a tolerance of plus 4% and a 2% tolerance for test error.

These specifications limit how far a struck golf ball will travel in several ways. Increasing the weight of a golf ball tends to increase the distance it will travel and lower the trajectory. A ball having greater momentum is better able to overcome drag. Reducing the diameter of the ball also has the effect of increasing the distance it will travel when hit. This is believed to occur primarily because a smaller ball has a smaller projected area and thus, a lower drag when traveling through the air. Increasing initial velocity increases the distance the ball will travel.

Drag on a golf ball is also reduced by forming a plurality of dimples, often circular, in the outer surface of the ball. The dimples serve to reduce the pressure differential between the front and rear of the ball as it travels through the air.

BRIEF DESCRIPTION OF THE PRIOR ART

Current golf ball patterns use various numbers of dimples having specific widths, usually laid out with the goal of maximizing surface coverage as long as symmetry in flight is maintained. Dimple depth is manipulated slightly to achieve a higher or lower trajectory, but the ratio of depth to width is constant on a golf ball at about 7%.

It is known in the patented prior art to provide a golf ball with two groups of dimples having the same diameter but two different depths as disclosed in the U.S. Pat. No. 5,518,246 to Moriyama. It is also known in the patented prior art to provide a golf ball having at least three sets of dimples wherein each of the sets of dimples has a different diameter and depth as disclosed in the Yamagishi U.S. Pat. No. 5,033,750. The ratio of the diameter to depth of the dimples of a particular set is approximately equal to the diameter to depth ratios of the other two sets.

The present invention was developed in order to provide a golf ball having a plurality of dimples of different depths wherein the different-depth dimples are arranged in a particular geometry having a dimple depth progression to improve the aerodynamic characteristics of the ball.

SUMMARY OF THE INVENTION

Accordingly, it is a primary object of the invention to provide a golf ball having a spherical surface and including a geometric pattern defined on the golf ball surface. Within the geometries of the pattern are provided a plurality of dimples comprising at least two groups. The first group of dimples has a first depth and the dimples thereof are arranged adjacent to a portion of the perimeter of the each geometry, and the second group of dimples has a second depth different from the first depth. The dimples of the second group are arranged within the first group of dimples. The first and second depths are independent of the widths of the dimples of the first and second groups. Owing to this arrangement of different depth dimples, the golf ball has improved aerodynamic properties.

According to another object of the invention, the golf ball includes a third group of dimples having a third depth different from the second depth and independent of the width of the third group of dimples. The third group of dimples is arranged within the second group of dimples so that a depth progression of dimples is provided within each geometry. In one embodiment, the first group of outer dimples has a greater depth than the second group which in turn has a greater depth than the innermost third group of dimples. In an alternative embodiment, the third group of innermost dimples has a greater depth than the second group which in turn has a greater depth than the outermost first group of dimples. In still another embodiment, the first and third groups of dimples have the same depth which is different from that of the second group of dimples.

It is yet another object of the invention to provide a number of great circles on the surface of the golf ball to define the geometric pattern which comprises a plurality of generally equal triangles. One of the great circles defines the equator of the ball and divides the ball into two hemispheres. The same number of triangles is thus provided in each hemisphere.

BRIEF DESCRIPTION OF THE FIGURES

Other objects and advantages of the invention will become apparent from a study of the following specification when viewed in the light of the accompanying drawing, in which.

DETAILED DESCRIPTION

Figure 2:
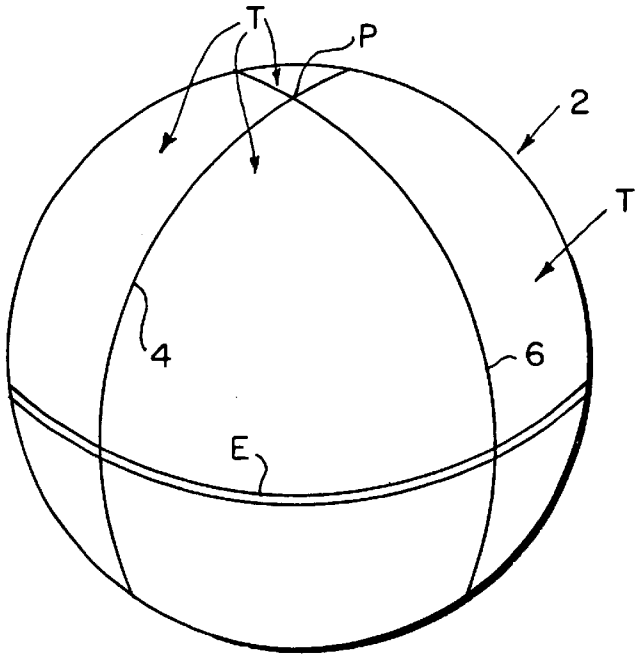
FIGS. 1 and 2 are plan views, respectively, of a spherical golf ball illustrating the manner of defining a geometric pattern on the surface of the ball.
Figure 1:
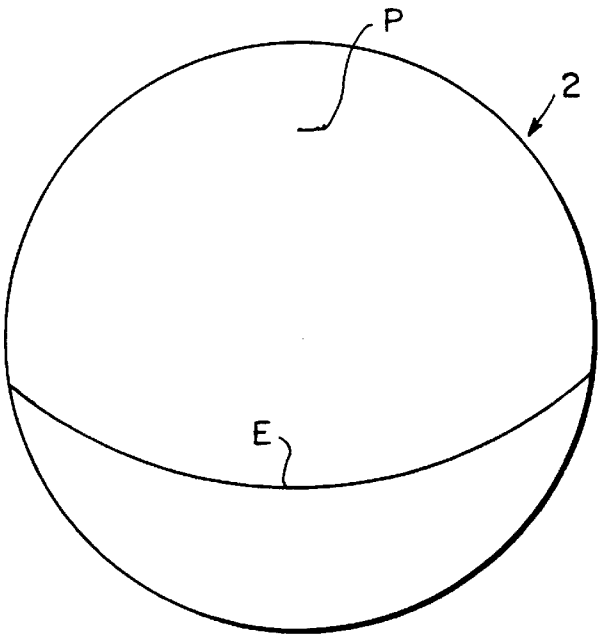

Referring to FIGS. 1 and 2, the golf ball 2 according to the invention has a spherical configuration formed by injection molding the ball in a cavity defined between two separable molding plates. Each plate has a hemispherical cavity, the cavities being adapted to mate when the plates are brought together. Thus, the golf ball has an equator E at the juncture of the molding plates which divides the ball into two identical hemispheres, each of which contains a pole P. Imaginary great circles are arranged on the surface of the ball and pass through the poles to divide the ball surface into a geometric pattern of equal sections or geometries. In FIG. 2, two circles 4,6 are shown which divide each hemisphere into four equal triangles T. Other geometric patterns can be defined on the surface of the ball in accordance with the invention. For example, a third great circle through the poles would divide each hemisphere into six triangular geometries.

Figure 5:
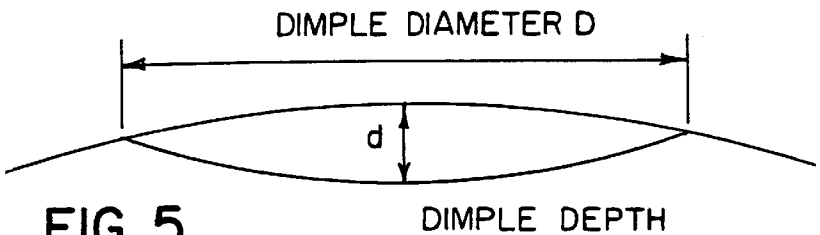
FIG. 5 is a sectional view of a dimple showing its diameter and depth.
Figure 4:
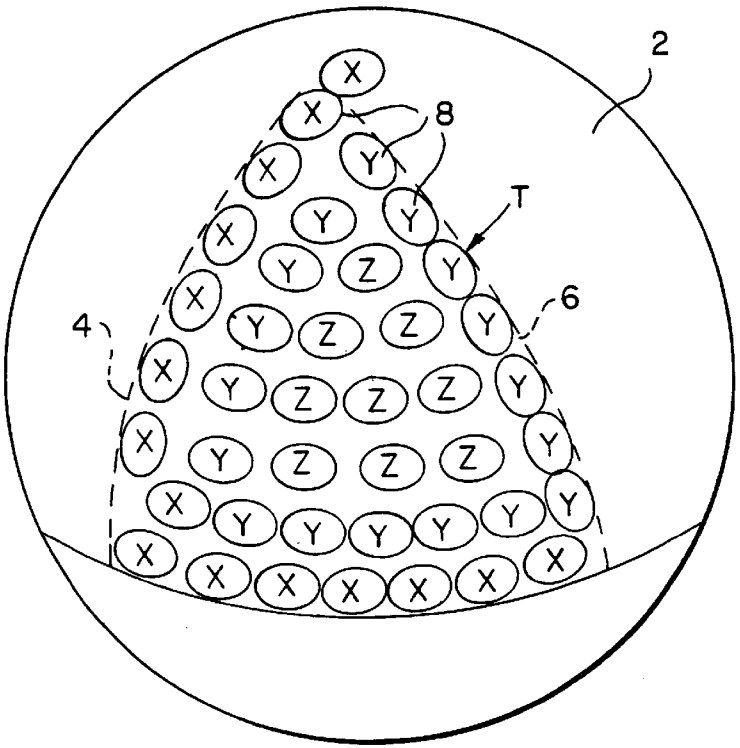
FIG. 4 is a plan view of a golf ball according to the invention including a second dimple pattern comprising three groups of dimples having a progressive depth.
Figure 3:
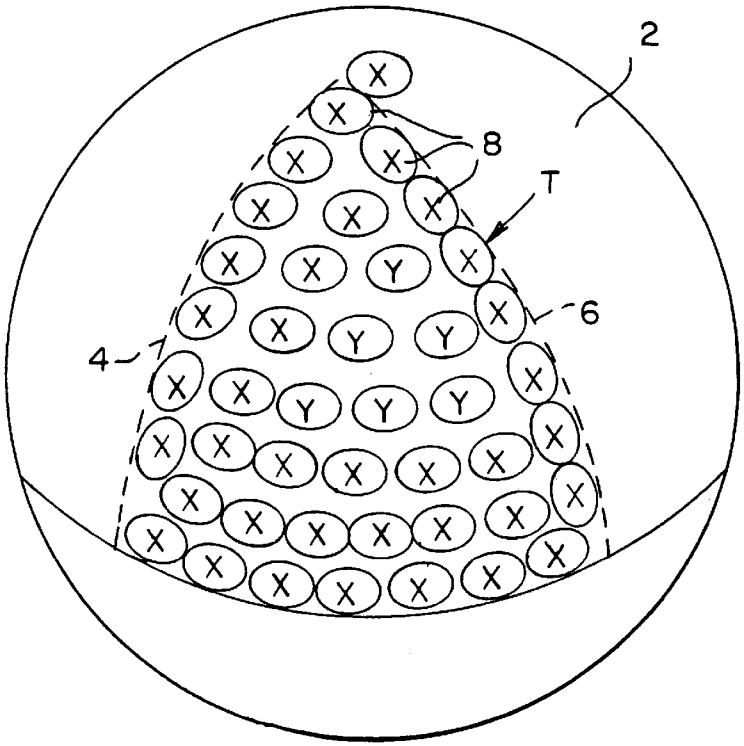
FIG. 3 is a plan view of a golf ball according to the invention including a first dimple pattern comprising three groups of dimples having a progressive depth.

Each of the triangles T is filled with a plurality of non-overlapping dimples 8 as shown in FIGS. 3 and 4. In FIG. 3, a first pattern of dimples within the triangle is shown, and in FIG. 4, a second pattern of dimples within the triangle is shown. The dimples are all circular and may have the same diameter. The diameter D is measured across the dimple between where the edges thereof intersect the surface of the ball as shown in FIG. 5. Alternatively, two or more groups of dimples may be provided with different diameters.

In conventional golf balls, the ratio of depth to width of a dimple is constant for all dimples on the ball. The depth d is defined as the maximum difference between the radius of the ball at the surface and the radius at the bottom of the dimple as shown in FIG. 5. The depth to width ratio in conventional golf balls is generally 7% or 1:14.3. In the golf ball according to the invention, the ratio is not constant. Rather a progression of the depth of the dimples within each triangle is provided.

In the embodiment of FIG. 3, there are shown two groups of dimples. The first group of dimples X all have a first depth and are arranged about the periphery of the triangle T. The second group of dimples Y all have a second depth different from the first depth. The depths of the first and second groups of dimples are independent of the dimple widths. The second dimples Y are arranged within the first group of dimples X. The first depth may be greater than the second depth, whereby the innermost dimples are shallower than the outermost dimples, resulting in an "outside-in" depth progression within each triangle. Conversely, the first depth may be less than the second depth, whereby the outermost dimples are shallower than the innermost dimples, resulting in an "inside-out" depth progression within each triangle.

In the embodiment of FIG. 4, there are shown three groups of dimples arranged within the triangle T. The dimples X of the first group all have a first depth, the dimples Y of the second group all have a second depth different from the first depth, and the dimples Z of the third group all have a third depth different from the second depth. The depths of the first, second, and third groups of dimples are all independent of the dimple widths. The first group of dimples X is arranged about a portion of the perimeter of the triangle T, the second group of dimples Y is arranged within the first group of dimples, and the third group of dimples Z is arranged within the second group of dimples Y. The first depth of the dimples X is greater than the second depth of the dimples Y which in turn is greater than the third depth of the dimples Z to define an "outside-in" depth progression within the triangle. Conversely, the first depth of the dimples X may be less than the second depth of the dimples Y which in turn may be less than the third depth of the dimples Z to define an "inside-out" depth progression. Alternatively, the first and third depths of the dimples X and Z may be equal but different from the second depth of the dimples Y to define an undulating depth progression within the each triangle.

With the dimple depth progression within a repetitive geometry across the surface of a golf ball, the ball is provided with superior aerodynamic properties. Depending on the depth progression selected, golf balls can be designed to achieve higher or lower trajectories.

While in accordance with the provisions of the patent statute the preferred forms and embodiments of the invention have been illustrated and described, it will be apparent to those of ordinary skill in the art that various changes and modifications may be made without deviating from the inventive concepts set forth above.

What is claimed is:

1. A golf ball having a spherical surface, comprising (a) a pattern defined on the golf ball surface, said pattern including a plurality of geometries, said geometries comprising triangles each having a perimeter defined by great circles on the golf ball surface, one of said great circles defining an equator which divides the golf ball surface into two hemispheres; and (b) a plurality of dimples arranged within said triangles, respectively, with said great circles and said triangles being free of dimples, said dimples comprising at least two groups of dimples, a first group of dimples having a first depth and being arranged exclusively in contiguous relation and adjacent to at least a portion of the perimeter of said triangles and a second group of dimples having a second depth different from said first depth and being arranged within said first group of dimples, said first and second depths being independent of a width of dimples of said first and second groups of dimples, respectively, and providing a dimple depth progression within each triangle either from a center portion of each triangle outward or from a perimeter portion of each triangle inward, whereby the golf ball has improved aerodynamic properties.

2. A golf ball as defined in claim 1, and further comprising a third group of dimples having a third depth different from said second depth and independent of a width of dimples of said third group of dimples, said third group of dimples being arranged within said second group of dimples.

3. A golf ball as defined in claim 2, wherein said first depth is less than said second depth which is less than said third depth.

4. A golf ball as defined in claim 1, wherein said triangles are generally equal in size and dimension, with the same number of triangles being provided in each hemisphere of the golf ball surface.

5. A golf ball as defined in claim 1, wherein the other of said great circles pass through poles in each of said hemispheres.

6. A golf ball having a spherical surface, comprising (a) a pattern defined on the golf ball surface, said pattern including a plurality of geometries, said geometries comprising triangles each having a perimeter defined by great circles on the golf ball surface, one of said great circles defining an equator which divides the golf ball surface into two hemispheres; and (b) a plurality of dimples arranged within said triangles, respectively, with said great circles and said triangles being free of dimples, said dimples comprising at least two groups of dimples, a first group of dimples having a first depth and being arranged exclusively in contiguous relation and adjacent to the entire perimeter of said triangles and a second group of dimples having a second depth different from said first depth and being arranged within said first group of dimples, said first and second depths being independent of a width of dimples of said first and second groups of dimples, respectively, and providing a dimple depth progression within each triangle either from a center portion of each triangle outward or from a perimeter portion of each triangle inward, whereby the golf ball has improved aerodynamic properties.

* * * * *